US010811755B2

(12) United States Patent
Su et al.

(10) Patent No.: US 10,811,755 B2
(45) Date of Patent: Oct. 20, 2020

(54) MICROSTRIP CAPACITORS WITH COMPLEMENTARY RESONATOR STRUCTURES

(71) Applicant: CommScope Technologies LLC, Hickory, NC (US)

(72) Inventors: Huafeng Su, Suzhou (CN); Biyang Ding, Suzhou (CN); Yongqiang Wang, Suzhou (CN); Yi Zhang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/092,896

(22) PCT Filed: Apr. 28, 2017

(86) PCT No.: PCT/US2017/030033

§ 371 (c)(1),
(2) Date: Oct. 11, 2018

(87) PCT Pub. No.: WO2017/189950

PCT Pub. Date: Nov. 2, 2017

(65) Prior Publication Data

US 2019/0207289 A1 Jul. 4, 2019

Related U.S. Application Data

(60) Provisional application No. 62/329,601, filed on Apr. 29, 2016.

(51) Int. Cl.
*H01P 7/08* (2006.01)
*H01P 9/04* (2006.01)
(Continued)

(52) U.S. Cl.
CPC ..... *H01P 7/082* (2013.01); *H01P 1/20336* (2013.01); *H01P 5/028* (2013.01); *H01P 9/04* (2013.01)

(58) Field of Classification Search
CPC ..... H01P 1/20336; H01P 9/04; H01P 7/082; H01P 5/028
(Continued)

(56) References Cited

U.S. PATENT DOCUMENTS

2012/0223869 A1 9/2012 Kim
2014/0266974 A1 9/2014 Sharawi

FOREIGN PATENT DOCUMENTS

CN 1901274 1/2007
CN 101471479 7/2009
(Continued)

OTHER PUBLICATIONS

Bindu et al., "Compact Band Notched UWB Filter for Wireless Communication Applications" (Year: 2015).*
(Continued)

*Primary Examiner* — Rakesh B Patel
(74) *Attorney, Agent, or Firm* — Myers Bigel, P.A.

(57) ABSTRACT

A microstrip capacitor structure includes a substrate having a first side and a second side opposite the first side wherein the first and second sides of the substrate are spaced apart in a vertical direction, first and second conductive microstrip transmission line segments on the first side of the substrate, a conductive ground plane on the second side of the substrate, first and second microstrip capacitor plates connected to respective ones of the first and second microstrip transmission line segments, wherein the first and second microstrip capacitor plates are separated by a dielectric gap, and a complementary resonator comprising a removed portion of the conductive ground plane that is aligned in the vertical direction with at least a portion of the dielectric gap. The first and second microstrip transmission line segments extend in a first direction of RF signal propagation and the complementary resonant structure comprises first and sec-
(Continued)

ond complementary resonant structures spaced apart in a second direction that is perpendicular to the first direction, and a transverse portion that extends in the second direction and connects the first and second complementary resonant structures.

20 Claims, 7 Drawing Sheets

(51) Int. Cl.
*H01P 5/02* (2006.01)
*H01P 1/203* (2006.01)

(58) Field of Classification Search
USPC ..... 333/202, 204, 205
See application file for complete search history.

(56) References Cited

FOREIGN PATENT DOCUMENTS

| | | |
|---|---|---|
| CN | 201349044 | 11/2009 |
| CN | 103715482 | 4/2014 |
| CN | 104466318 | 3/2015 |
| CN | 105226356 | 1/2016 |

OTHER PUBLICATIONS

Verma et al., "Design of low-pass filters using some defected ground structures" (Year: 2011).*
PCT International Preliminary Report on Patentability corresponding to PCT/US2017/030033, dated Nov. 8, 2018 (9 pages).
Amir Ebrahimi et al., "Dual-mode behavior of the complementary electric-LC resonators loaded on transmission line: Analysis and applications", Journal of Applied Physics 116(8):083705, Aug. 2014 (See pp. 3-5; and figures 4(a), 8(a)).
Mohammed M. Bait-Suwailam et al., "Mutual Coupling Reduction Between Microstrip Patch Antennas Using Slotted-Complementary Split-Ring Resonators", IEEE Antennas and Wireless Propagation, Letters, vol. 9, Feb. 2010, See pp. 876-878.
Amlr Ebrahlmi et al., "Compact Dual-Mode Wideband Filter Based on Complementary Split-Ring Resonator", IEEE Microwave and Wireless Components, Letters 24(3), Mar. 2014, See pp. 1-3.
PCT International Search Report corresponding to PCT/US2017/030033, dated Aug. 4, 2017 (3 pages).
PCT Written Opinion corresponding to PCT/US2017/030033, dated Aug. 4, 2017 (7 pages).
Boutejdar et al., "Extracting of Compact Tunable BPF from LPF using Single T-DGS-Resonator and 0.25PF/0.5PF Chip Monolithic Ceramic Capacitors", 2015 4th International Conference on Electrical Engineering (ICEE), IEEE, Dec. 13, 2015, pp. 1-5.
Song et al., "Compact UWB Bandpass Filter With Dual Notched Bands Using Defected Ground Structures", IEEE Microwave and Wireless Components Letters, vol. 24, No. 4, Apr. 2014, pp. 230-232.
Extended European Search Report dated November Nov. 25, 2019 for corresponding European Patent Application No. EP 17 79 0496, (17 pages).
Chinese Office Action corresponding to CN 201780026349.4; dated Apr. 22, 2020 (15 pages including English translation).

* cited by examiner

MICROSTRIP CAPACITORS WITH COMPLEMENTARY RESONATOR STRUCTURES

CROSS-REFERENCE TO RELATED APPLICATIONS

This application is a 35 U.S.C. § 371 national stage application of PCT Application No. PCT/US2017/030033, filed on Apr. 28, 2017, which itself claims priority to U.S. Provisional Patent Application No. 62/329,601, filed Apr. 29, 2016, the entire contents of the applications are incorporated by reference herein as if set forth in their entireties. The above-referenced PCT Application was published in the English language as International Publication No. WO 2017/189950 A1 on Nov. 2, 2017.

BACKGROUND

Antennas for wireless communications use microstrip transmission line segments to transfer radio frequency (RF) signals to/from the radiating elements of the antenna. In antenna systems for RF communications, it is desirable to include a DC blocking capacitor in a microstrip antenna transmission line that allows RF signals within a predetermined RF bandwidth to pass through the transmission line, but that substantially attenuates DC and low frequency signal components that may be present on the transmission line.

A microstrip transmission line segment structure generally includes a dielectric substrate on which a conductive microstrip line is formed, for example, by metallization and etching. A conductive ground plane is formed on an opposite side of the dielectric substrate from the microstrip line to facilitate propagation of RF signals along the microstrip line.

For RF transmission lines that carry RF signals in the megahertz (MHz) and gigahertz (GHz) range, it may be desirable for a capacitor that blocks DC and low frequency signals (herein, a "DC blocking capacitor") to have a capacitance on the order of about 45 pF or more. While it is possible to form a DC blocking capacitor in a microstrip structure, it is difficult to form a microstrip capacitor having a capacitance as large as needed to effectively block the DC and low frequency components.

The capacitance of a microstrip capacitor is determined by the physical dimensions of the microstrip capacitor plates and the dielectric material that separates the microstrip capacitor plates, as well as other factors, such as the thickness and material of the dielectric substrate. With conventional microstrip planar capacitor structures, it is difficult to obtain a capacitance greater than about 5 pF.

While a double microstrip capacitor can be formed to have a capacitance greater than 5 pF, the presence of a double microstrip capacitor in an antenna transmission line can lead to a number of problems, including increased return losses and/or spurious RF emissions, either of which can adversely impact the operation of the antenna system. For example, the spurious RF emissions may degrade the front-to-back (FB) performance of the antenna.

SUMMARY

In some embodiments of the inventive concept, a microstrip capacitor structure comprises a substrate having a first side and a second side opposite the first side wherein the first and second sides of the substrate are spaced apart in a vertical direction, first and second conductive microstrip transmission segments on the first side of the substrate, a conductive ground plane on the second side of the substrate, first and second microstrip capacitor plates connected to respective ones of the first and second microstrip transmission line segments, wherein the first and second microstrip capacitor plates are separated by a dielectric gap, and a complementary resonator comprising a removed portion of the conductive ground plane that is aligned in the vertical direction with at least a portion of the dielectric gap. The first and second microstrip transmission line segments extend in a first direction of RF signal propagation and the complementary resonant structure comprises first and second complementary resonant structures spaced apart in a second direction that is perpendicular to the first direction, and a transverse portion that extends in the second direction and connects the first and second complementary resonant structures.

In other embodiments, first and second microstrip capacitor plates comprise an interdigitated capacitor structure.

In still other embodiments, each of the first and second microstrip capacitor plates comprises a transverse portion and a plurality of microstrip fingers that extend in the first direction from the transverse portion, wherein the respective microstrip fingers of the first and second microstrip capacitor plates overlap in the first direction.

In still other embodiments, each of the first and second microstrip capacitor plates comprises a transverse portion and a plurality of microstrip fingers that extend in the first direction from the transverse portion, wherein the respective microstrip fingers of the first and second microstrip capacitor plates are interdigitated.

In still other embodiments, the first and second microstrip capacitor plates are arranged so that a majority of electric field lines, extending between the first and second microstrip capacitor plates are oriented in the second direction.

In still other embodiments, the first and second microstrip capacitor plates are arranged so that a majority of electric field lines extending between the first and second microstrip capacitor plates are oriented in the first direction.

In still other embodiments, the complementary resonant structures are configured to resonate at a frequency that increases capacitance between the first and second microstrip capacitor plates while maintaining a return loss less than −25 dB.

In still other embodiments, the microstrip capacitor structure has a capacitance of about 3 pF to about 4 pF.

In still other embodiments, each of the complementary resonant structures comprises a spiral shape.

In still other embodiments, each of the complementary resonant structures comprises a serpentine shape.

In still other embodiments, each of the complementary resonant structures comprises a polygonal shape.

In still other embodiments, each of the complementary resonant structures has an area greater than an area of the transverse portion of the complementary resonator.

In still other embodiments, at least portions of the first and second microstrip capacitor plates are not aligned in the vertical direction with the removed portion of the ground plane.

In still other embodiments, the microstrip capacitor structure has a return loss of less than −25 dB over an RF bandwidth from 0.69 GHz to 1.0 GHz.

In still other embodiments, the complementary resonant structures are configured to resonate at a frequency of RF signals carried by the first and second microstrip transmission line segments.

It is noted that aspects described with respect to one embodiment may be incorporated in different embodiments although not specifically described relative thereto. That is, all embodiments and/or features of any embodiments can be combined in any way and/or combination. Moreover, other apparatus, methods, systems, and/or articles of manufacture according to embodiments of the inventive subject matter will be or become apparent to one with skill in the art upon review of the following drawings and detailed description. It is intended that all such additional apparatus, systems, methods, and/or articles of manufacture be included within this description, be within the scope of the present inventive subject matter, and be protected by the accompanying claims. It is further intended that all embodiments disclosed herein can be implemented separately or combined in any way and/or combination.

BRIEF DESCRIPTION OF THE DRAWINGS

Other features of embodiments will be more readily understood from the following detailed description of specific embodiments thereof when read in conjunction with the accompanying drawings, in which.

DETAILED DESCRIPTION

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Some embodiments described herein provide microstrip capacitors suitable for use in conjunction with antenna transmission lines. Microstrip capacitors as described herein are capable of obtaining high capacitance values with low return loss. For example, microstrip capacitors as described herein may be capable of having a return loss of less than −25 dB over an RF bandwidth from 0.69 GHz to 1.0 GHz.

According to some embodiments, a microstrip capacitor includes first and second, microstrip capacitor plates on the opposite side of a dielectric substrate from a conductive ground plane. A complementary resonator is formed in the conductive ground plane and includes a removed portion of the conductive ground plane. The complementary resonator is aligned in the vertical direction with at least a portion of the dielectric gap, and includes first and second complementary resonant structures and a transverse portion that connects the first and second complementary resonant structures.

Figure 1:
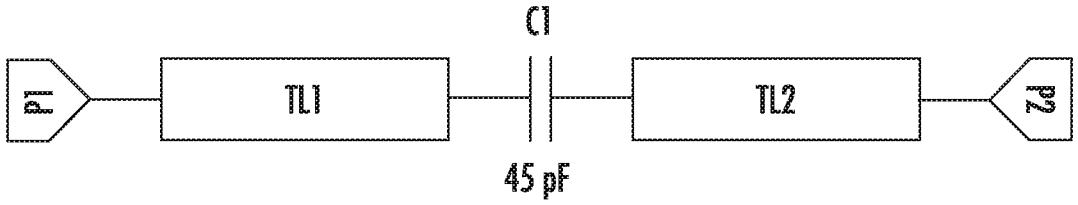
FIG. 1 is a schematic diagram illustrating the positioning of a DC blocking capacitor in a transmission line according to some embodiments of the inventive concept.

FIG. 1 is a schematic diagram illustrating the positioning of a DC blocking capacitor C1 in a transmission line including a first microstrip transmission line segment and a second microstrip transmission line segment T2. Port P1 is connected to the first microstrip transmission line segment T1, while port P2 is connected to second microstrip transmission line segment T2. The DC blocking capacitor C1 is connected between the first microstrip transmission line segment T1 and the second microstrip transmission line segment T2.

An RF signal applied at port P1 passes through the first microstrip transmission line segment T1. DC components of the RF signal may be attenuated by the DC blocking capacitor C1, while RF components of the RF signal pass through the DC blocking capacitor C1 to the second microstrip transmission line segment T2. It is desirable for the return loss of a signal applied at port P1, termed the S(1,1) coefficient, to be less than −25 dB. Likewise, it is desirable for the return loss of a signal applied at port P2, termed the S(2,2) coefficient, to be less than −25 dB.

Figure 2A:
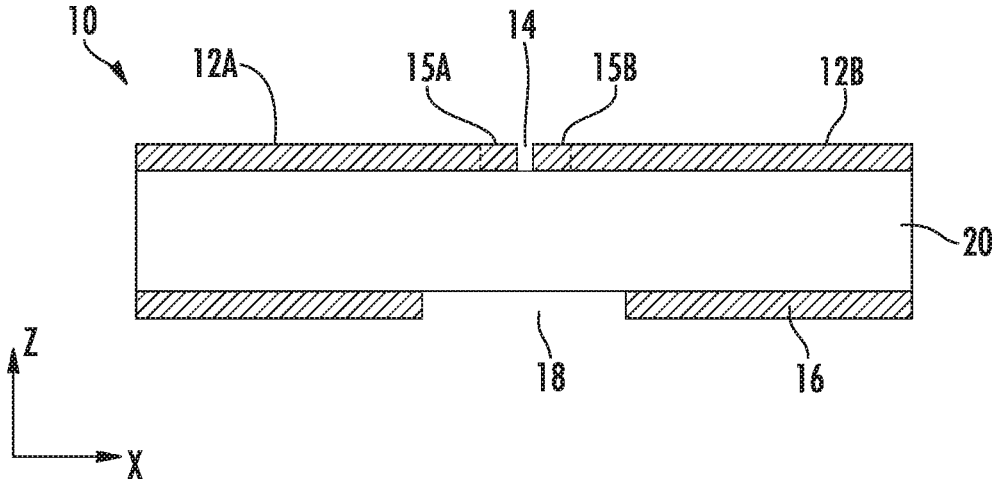
FIGS. 2A and 2B are side and plan views, respectively, of a conventional microstrip capacitor structure.
Figure 2B:
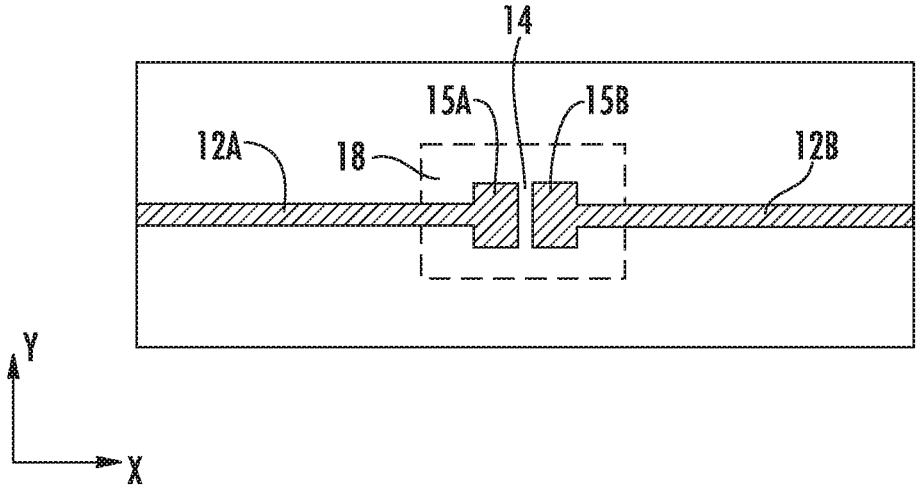

FIG. 2A is a side view and FIG. 2B is a top or plan view, respectively, of a conventional microstrip capacitor structure 10. The microstrip capacitor structure 10 includes a dielectric substrate 20 including a top surface and a bottom surface. A conductive ground plane 16 is formed on the bottom surface of the dielectric substrate, while first and second conductive microstrip transmission line segments 12A, 12B on the top surface of the dielectric substrate 20. The first and second conductive microstrip transmission hue segments 12A, 12B extend in a first direction (x-direction), which defines a direction of RF signal propagation in the transmission lines. The first and second conductive microstrip transmission line segments 12A, 12B connect to respective first and second microstrip capacitor plates 15A, 15B which are separated by a gap 14.

A portion 18 of the conductive ground plane 16 beneath the microstrip capacitor plates 15A, 15B is removed (or alternatively, never deposited) to enhance the coupling of the microstrip capacitor plates 15A, 15B. However, even with the portion 18 of the conductive ground plane 16 beneath the microstrip capacitor plates 15A, 15B being removed, the capacitor structure 10 may still suffer from unacceptable return loss at certain RF frequencies of operation and/or low capacitance.

Figure 3A:
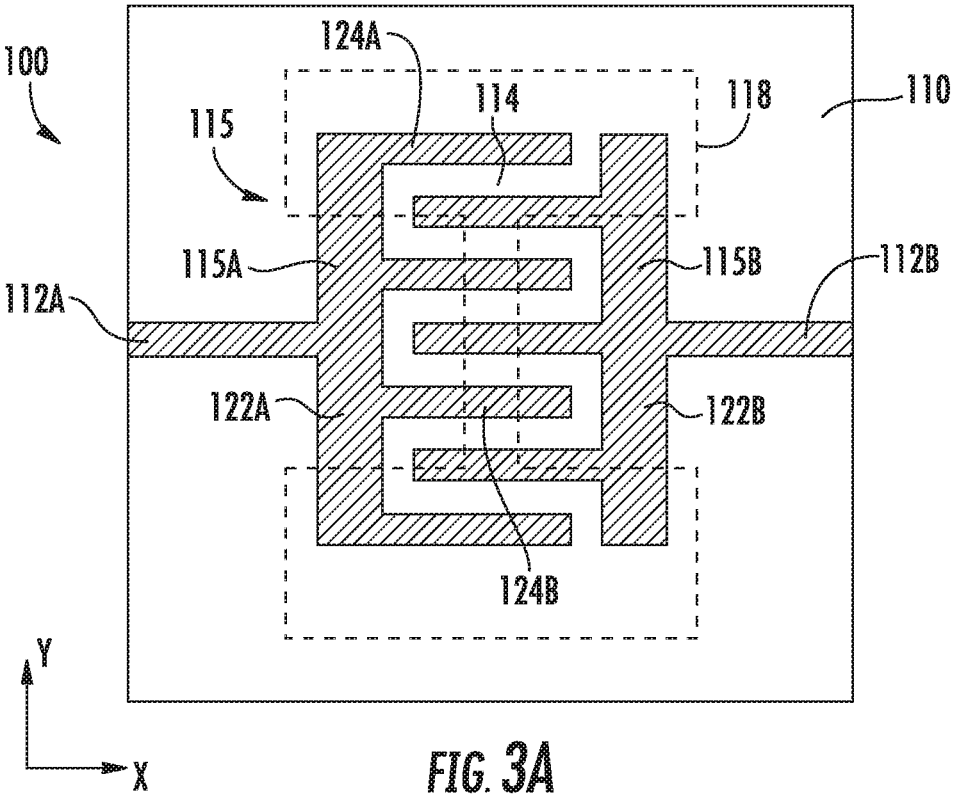
FIGS. 3A and 3B are plan and bottom views, respectively, of a microstrip capacitor structure according to some embodiments of the inventive concept.
Figure 3B:
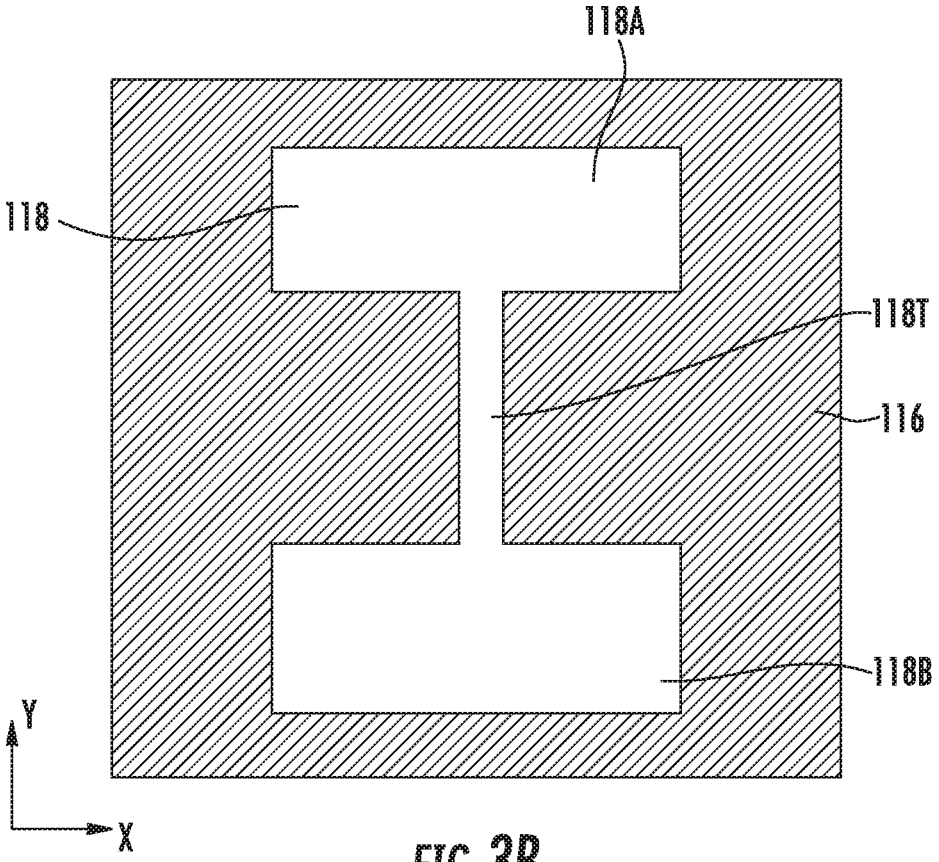

FIGS. 3A and 3B are top and bottom views, respectively, of a microstrip capacitor 100 according to some embodiments of the inventive concepts. The microstrip capacitor structure 100 includes a dielectric substrate 110 including a top surface and a bottom surface. A conductive ground plane 116 is formed on the bottom surface of the dielectric substrate 110, while first and second conductive microstrip transmission line segments 112A, 112B are formed on the top surface of the dielectric substrate 110. The first and second conductive microstrip transmission line segments 112A, 112B extend in a first direction (x direction), which defines a direction of RF signal propagation in the transmission lines. The first and second conductive microstrip transmission line segments 112A, 112B connect to respective first and second microstrip capacitor plates 115A, 115B which form an inter-digitated capacitor structure 115.

The first and second microstrip capacitor plates 115A, 115B include transverse portions 122A, 122B that are connected to the microstrip transmission line segments 112A, 112B, and that extend in a second direction (y-direction) that is transverse to the direction of RF signal flow. That is, the transverse portions 122A, 122B are perpendicular to the first and second microstrip transmission line segments 112A, 112B. A plurality of conductive capacitor fingers 124A, 124B extend from the respective transverse portions 122A, 122B toward the opposite transverse portions 122A, 122B and overlap with one another in the second direction (y-direction) in an interdigitated fashion. Accordingly, the majority of the capacitance between the first and second microstrip capacitor plates 115A, 115B is determined by the amount of overlap between the conductive capacitor fingers 124A, 124B and the distance (gap) 114 between the respective conductive capacitor fingers 124A, 124B.

Moreover, it will be appreciated that because the conductive capacitor fingers 124A, 124B extend in the first direction (X-direction) and overlap in the second direction (y-direction), the majority of electric field lines between the conductive capacitor fingers 124A, 124B extend in the second direction (y-direction) that is perpendicular to the direction of signal flow in the first and second microstrip transmission line segments 112A, 112B.

The microstrip transmission line segments 112A, 112B and the microstrip capacitor plates 115A, 115B including the transverse portions 122A, 122B and conductive capacitor fingers 124A, 124B may be formed by blanket deposition of a layer of a metal, such as copper, on the dielectric substrate 110 followed by selective etching of the deposited metal to define the transmission lines and capacitor plates, as is known in the art.

The interdigitated capacitor structure may have a capacitance of about 3.4 pF.

Referring to FIG. 3B, a portion of the conductive ground plane 116 is removed to form a complementary resonator 118 that is vertically aligned (i.e., aligned in the z-direction) with at least a portion of the gap 114 between the first and second capacitor plates 115A, 115B.

The complementary resonator structure 118 may have a "dumbbell" structure including first and second complementary resonant structures 118A, 118B connected by a transverse structure 115T. Each of the complementary resonator structures 118A, 118B may have a size and/or shape that is configured to create a resonance in the ground plane beneath the capacitor gap 114 that resonates at a frequency corresponding to a frequency of an RF signal carried on the microstrip transmission line segments 112A, 112B.

In some embodiments, the complementary resonator structures 118A, 118B may together have a size and/or shape that are configured to create a resonance in the ground plane beneath the capacitor gap 114 that resonates at a frequency corresponding to a frequency of an RF signal carried on the microstrip transmission line segments 112A, 112B.

While not wishing to be bound by a particular theory, it is presently believed that the presence of a complementary resonant structure formed by selectively removing portions of the ground plane beneath the capacitor structure may enhance coupling between the capacitor plates of the capacitor structure while reducing reflections that may occur at frequencies corresponding to a resonant frequency of the complementary resonant structure and consequently improve return loss performance.

The complementary resonator structures 118A, 118B may each occupy an area that is larger than the area of the transverse structure 118T that connects the complementary resonator structures 118A, 118B. This dumbbell structure normally has a compact size due to the complementary resonator structures 118A, 118B.

In some embodiments, each of the complementary resonator structures 118A, 118B may have a regular polygonal shape, such as a square, rectangle etc. However, it will be appreciated that the complementary resonator structures 118A, 118B may have other shapes and/or sizes.

The complementary resonator structures 118A, 118B may be formed in this manner to be mutually offset from a center of the capacitor structure in the second direction, i.e., transverse to the direction of signal propagation in the microstrip transmission line segments 112A, 112B.

While not wishing to be bound by a particular theory of operation, it is presently believed that by offsetting the complementary resonator structures 118A, 118B to be mutually offset from a center of the capacitor structure in a direction transverse to the direction of signal propagation in the microstrip transmission line segments 112A, 112B, the insertion loss of the capacitor can be reduced.

As illustrated in FIG. 3A, at least a portion of the capacitor plates 115A, 115B, and in particular a portion of the transverse portions 122A, 122B of the do not lie over removed portions of the ground plane 116 that form the complementary resonator 118. Moreover, at least a portion of the gap 114 between the capacitor plates 115A, 115B may not lie over removed portions of the ground plane 116 that form the complementary resonator 118. Finally, a significant portion, e.g., more than 50%, of the complementary resonant structures 118A, 118B, may fall outside a footprint of the capacitor plates 115A, 115B so as not to be vertically aligned with the capacitor plates 115A, 115B.

Figure 4A:
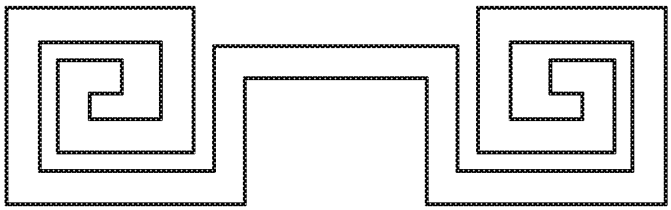
FIGS. 4A-4C are diagrams that illustrate configurations of a complementary resonator according to some embodiments of the inventive concept.
Figure 4B:
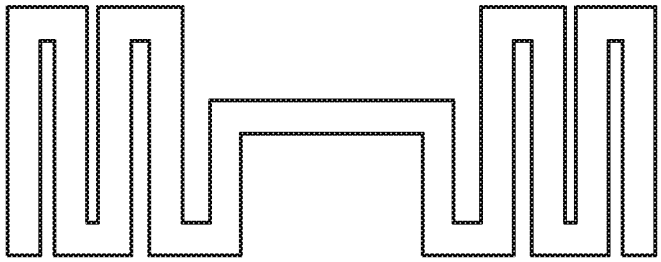
Figure 4C:
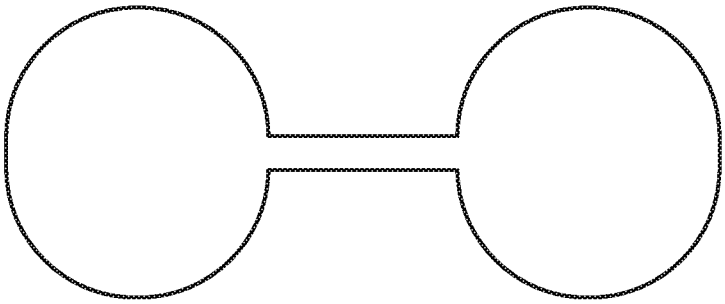

FIGS. 4A to 4C illustrate various potential configurations of a complementary resonator 118. For example, as illustrated in FIGS. 4A to 4C, each of the complementary resonator structures 118A, 118B may have a spiral shape (FIG. 4A), a serpentine shape (FIG. 4B), or a non-polygonal shape, such as an oval shape (FIG. 4C). In each case, however, the complementary resonator structures 118A, 118B are connected to each other via a transverse member that extends in the second direction perpendicular to the direction of RF signal propagation.

Figure 5:
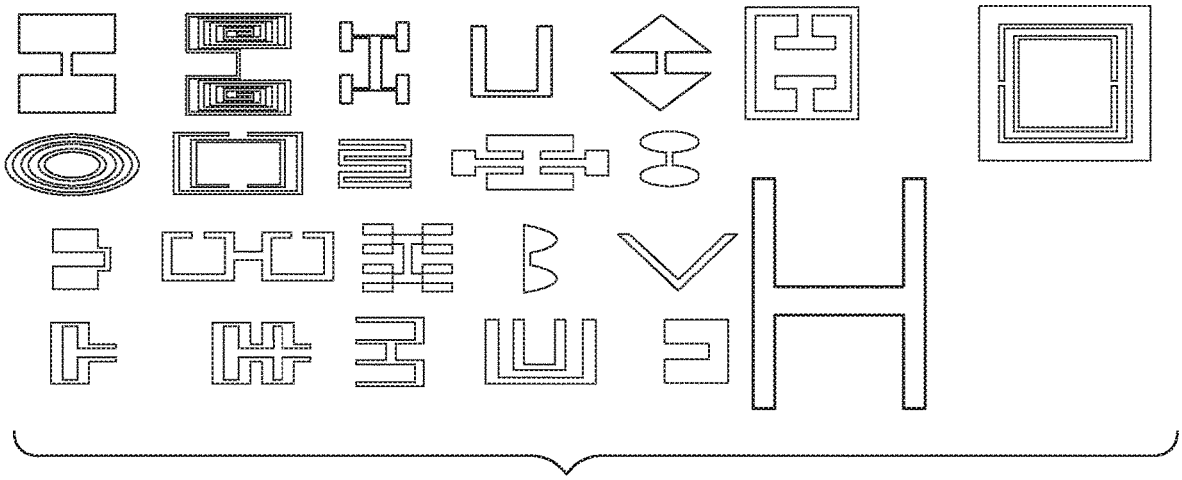
FIG. 5 is a diagram that illustrates further configurations of a complementary resonator according to some embodiments of the inventive concept.

FIG. 5 illustrates various other shapes that can be used to form a complementary resonator structure according to various embodiments.

Figure 6:
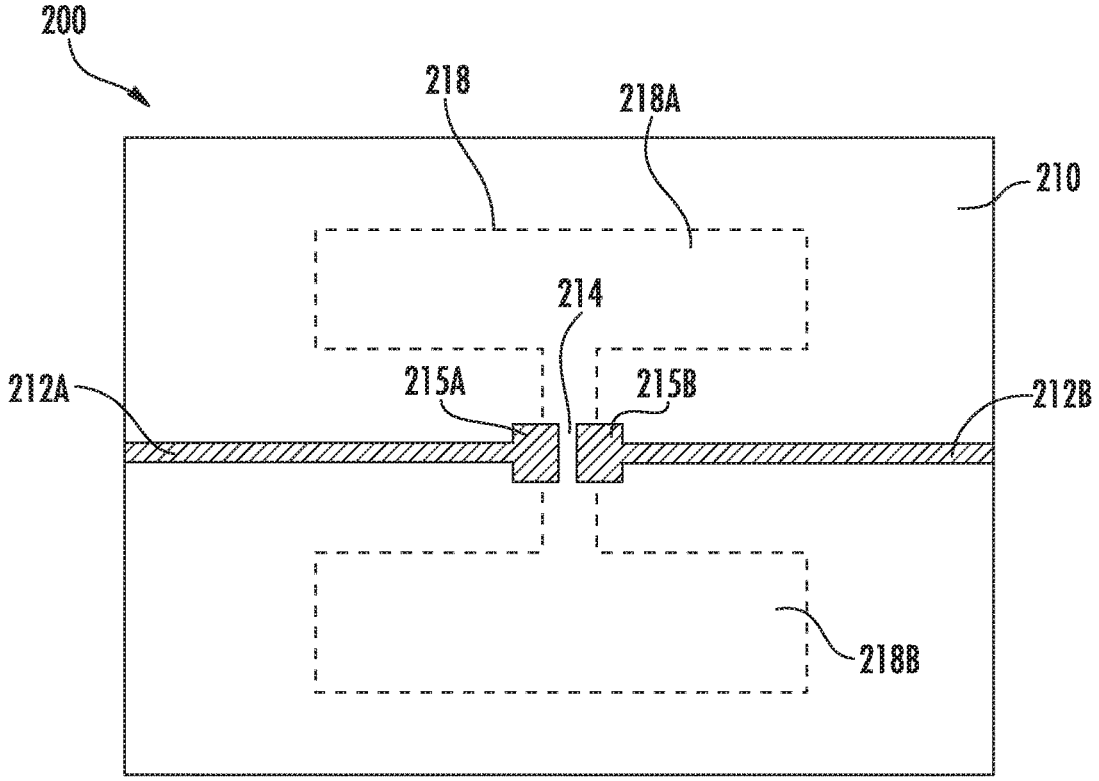
FIG. 6 is a plan view of a microstrip capacitor structure according to some embodiments of the inventive concept.

Referring to FIG. 6, a microstrip capacitor structure 200 according to further embodiments is illustrated in plan view.

The microstrip capacitor structure 200 includes a dielectric substrate 210 including a top surface and a bottom surface. A conductive ground plane 216 is formed on the bottom surface of the dielectric substrate 210, while first and second conductive microstrip transmission line segments 212A, 212B are formed on the top surface of the dielectric substrate 210. The first and second conductive microstrip transmission line segments 212A, 212B extend in a first direction (x-direction), which defines a direction of RF signal propagation m the transmission lines. The first and second conductive microstrip transmission line segments 212A, 212B connect to respective first and second microstrip capacitor plates 215A, 215B which are separated by a gap 214. The gap 214 extends in the second direction, such that electric field lines between the first and second microstrip capacitor plates 215A, 215B extend in the first direction.

A portion of the conductive ground plane 216 is removed to define a dumbbell-shaped complementary resonator 218 including complementary resonator structures 218A, 218B connected by a transverse portion 218T.

As illustrated in FIG. 5, at least a portion of the capacitor plates 215A, 215B may not lie over removed portions of the ground, plane 216 that form the complementary resonator 218. Finally a significant portion, e.g., more than 50%, of the complementary resonant structures 218A, 218B, may fall outside a footprint of the capacitor plates 215A, 215B so as not to be vertically aligned with the capacitor plates 215A, 215B.

As described above, a microstrip capacitor structure according to sortie embodiments may have a return loss of less than −25 dB over an RF bandwidth from 0.69 GHz to 1.0 GHz.

Figure 7:
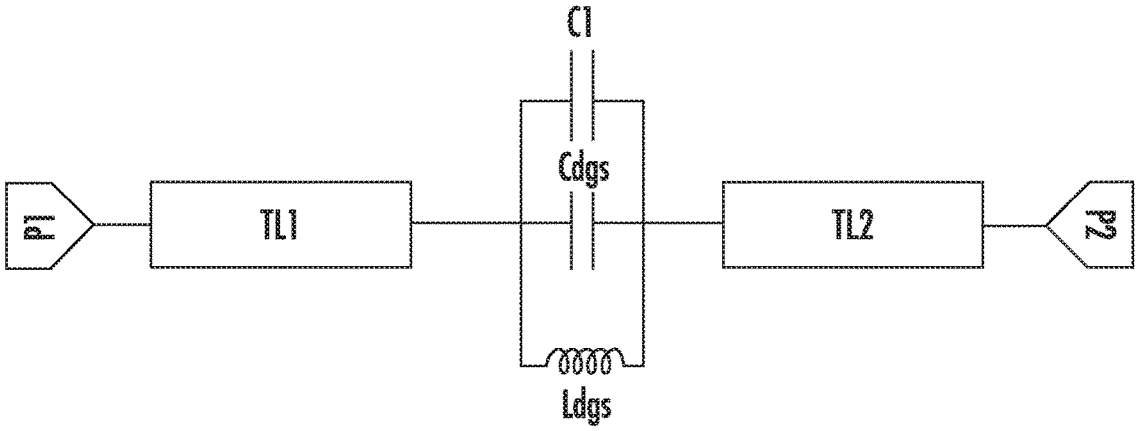
FIG. 7 is an equivalent circuit schematic for a transmission line including a DC blocking capacitor having a structure as illustrated in FIGS. 3A and 3B according to some embodiments of the inventive concept.

FIG. 7 illustrates an equivalent circuit for a transmission line including a DC blocking capacitor having a structure as shown in FIGS. 3A and 3B. In particular, the complementary resonator 118 may be modeled as a parallel capacitance Cdgs and inductance Ldgs in parallel with the capacitance C1 of the interdigitated capacitor structure 115. The complementary resonator 118 thus appears as a shunt resonator in parallel with the interdigitated capacitor 115. This may provide a wideband return loss even with a small capacitance of the interdigitated capacitor 115.

Figure 8:
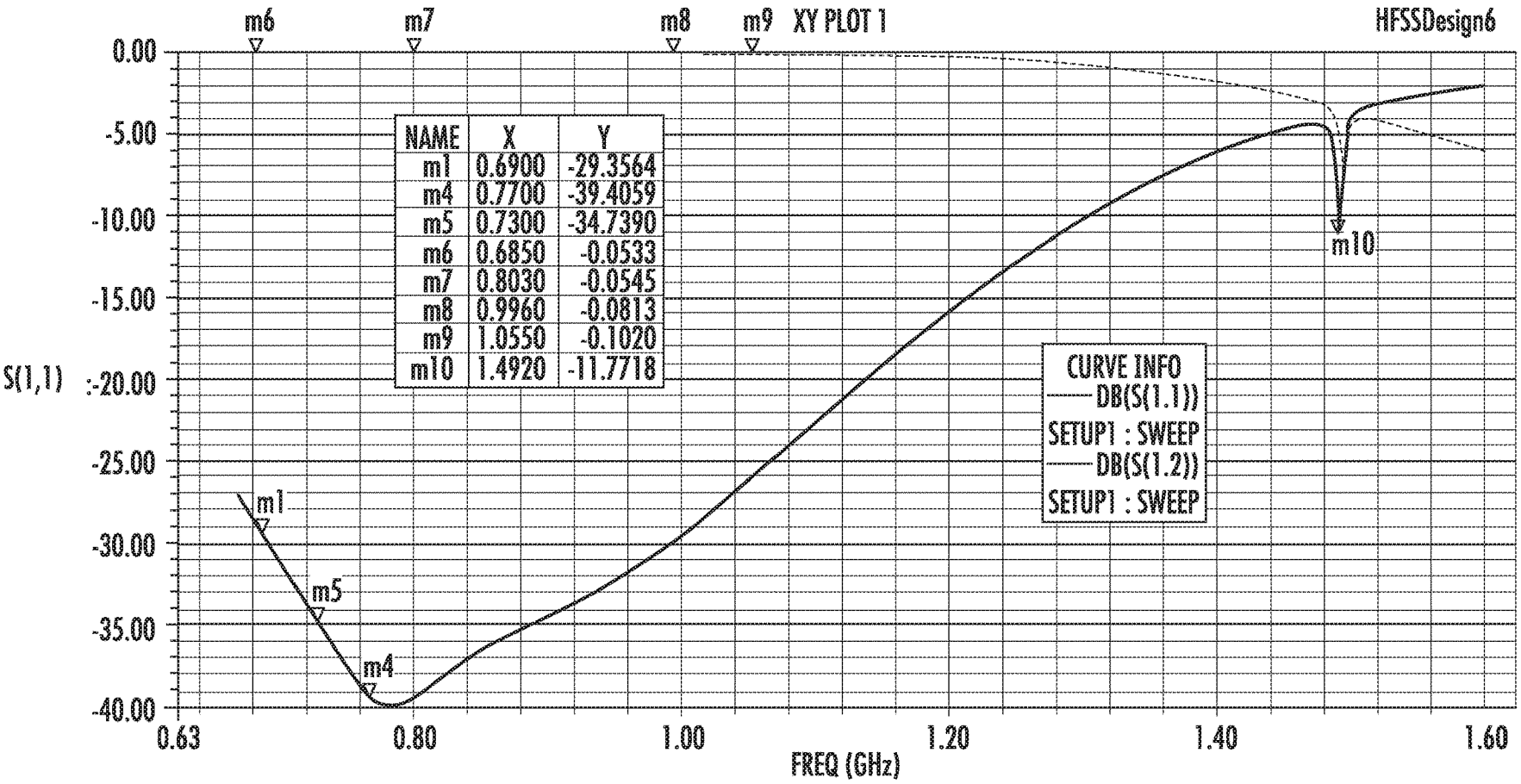
FIG. 8 is a simulation graph of the return loss coefficient for a device having a dumbbell shaped complementary resonator structure beneath an interdigitated capacitor according to some embodiments of the inventive concept.
Figure 9:
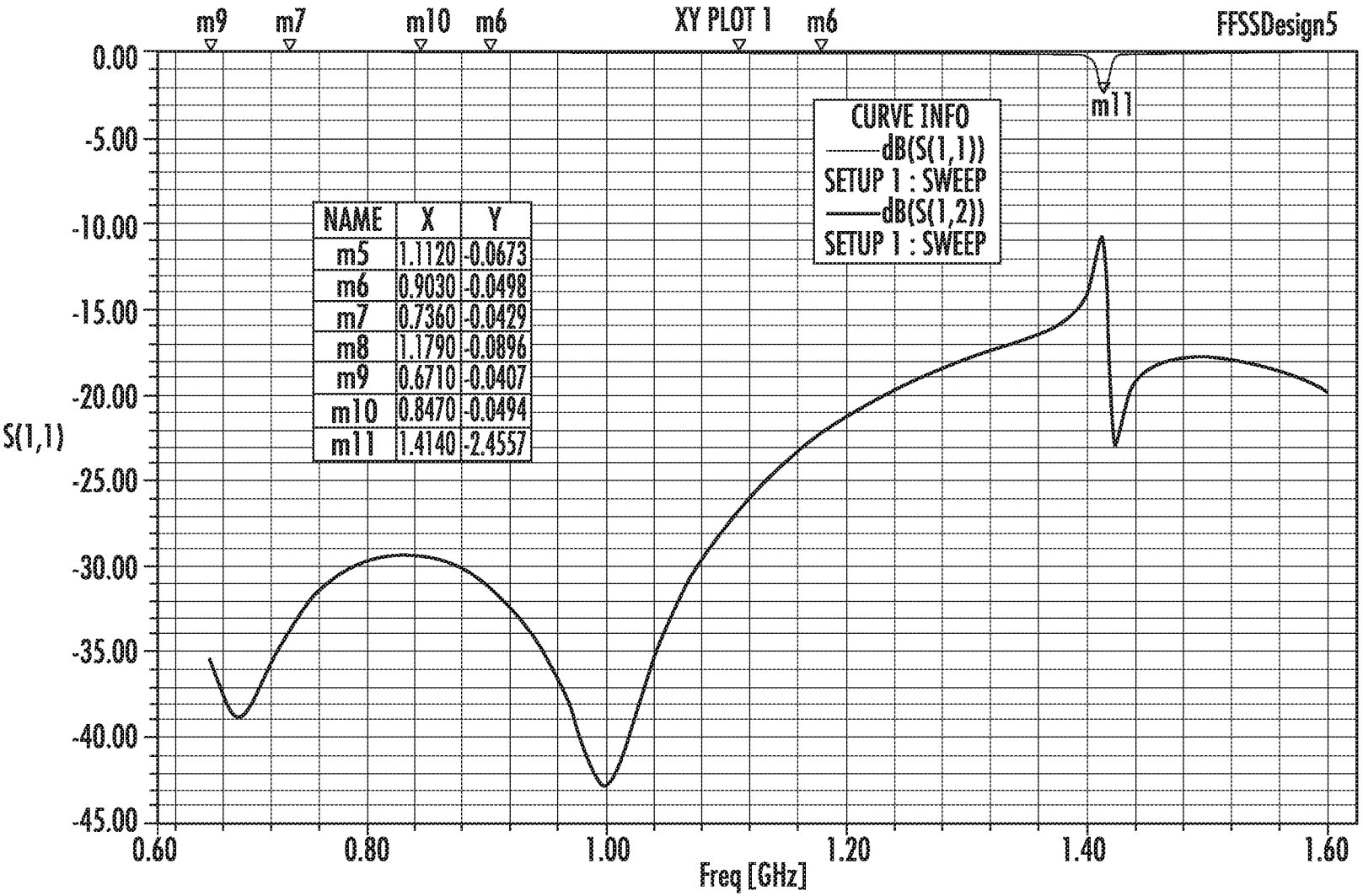
FIG. 9 is a simulation graph of the return loss coefficient for a device having a rectangular shaped complementary resonator structure beneath an interdigitated capacitor according to some embodiments of the inventive concept

FIG. 8 is a simulation graph of the return loss coefficient S(1,1) for a device having a dumbbell shaped complementary resonator structure beneath interdigitated capacitor, while FIG. 9 is a graph of the return loss coefficient S(1,1) for a device having a rectangular shaped complementary resonator structure beneath an interdigitated capacitor. In both cases, the return loss in the range of 690 MHz to 960 MHz is less than −29 dB, although the return loss is lower for the device with the dumbbell shaped complementary resonator structure. Thus, even though the interdigitated capacitor has a capacitance of only 3.4 pF, the capacitor is capable of blocking DC signals, over the 690-960 MHz band due to the presence of the complementary resonator structure.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

In the specification, there have been disclosed embodiments of the invention and, although specific terms are employed, they are used in a generic and descriptive sense only and not for purposes of limitation.

What is claimed is:

1. A microstrip capacitor structure, comprising:

a substrate having a first side and a second side opposite the first side, wherein the first and second sides of the substrate are spaced apart in a vertical direction;

first and second conductive microstrip transmission line segments on the first side of the substrate;

a conductive ground plane on the second side of the substrate;

first and second microstrip capacitor plates connected to respective ones of the first and second microstrip transmission line segments, wherein the first and second microstrip capacitor plates are separated by a dielectric gap;

a complementary resonator comprising a removed portion of the conductive ground plane that is aligned in the vertical direction with at least a portion of the dielectric gap;

wherein the first and second microstrip transmission line segments extend in a first direction of RF signal propagation;

wherein the complementary resonator comprises first and second complementary resonant structures spaced apart in a second direction that is perpendicular to the first direction, and a transverse portion that extends in the second direction and connects the first and second complementary resonant structures; and wherein the complementary resonant structures are configured to resonate at a frequency that increases capacitance between the first and second microstrip capacitor plates while maintaining a return loss less than −25 dB.

2. The microstrip capacitor structure of claim 1, wherein the first and second microstrip capacitor plates comprise an interdigitated capacitor structure.

3. The microstrip capacitor structure of claim 2, wherein each of the first and second microstrip capacitor plates comprises a transverse portion and a plurality of microstrip fingers that extend in the first direction from the transverse portion, wherein the respective microstrip fingers of the first and second microstrip capacitor plates overlap in the first direction.

4. The microstrip capacitor structure of claim 2, wherein each of the first and second microstrip capacitor plates comprises a transverse portion and a plurality of microstrip fingers that extend in the first direction from the transverse portion, wherein the respective microstrip fingers of the first and second microstrip capacitor plates are interdigitated.

5. The microstrip capacitor structure of claim 1, wherein the first and second microstrip capacitor plates are arranged so that a majority of electric field lines extending between the first and second microstrip capacitor plates are oriented in the second direction.

6. The microstrip capacitor structure of claim 1, wherein the complementary resonant structures are configured to resonate at a frequency of RF signals carried by the first and second microstrip transmission line segments.

7. The microstrip capacitor structure of claim 1, wherein at least portions of the first and second microstrip capacitor plates are not aligned in the vertical direction with the removed portion of the ground plane.

8. The microstrip capacitor structure of claim 1, wherein the microstrip capacitor structure has a capacitance of about 3 pF to about 4 pF.

9. The microstrip capacitor structure of claim 1, wherein each of the complementary resonant structures comprises a spiral shape.

10. The microstrip capacitor structure of claim 1, wherein each of the complementary resonant structures comprises a serpentine shape.

11. The microstrip capacitor structure of claim 1, wherein each of the complementary resonant structures comprises a polygonal shape.

12. The microstrip capacitor structure of claim 1, wherein each of the complementary resonant structures has an area greater than an area of the transverse portion of the complementary resonator.

13. A microstrip capacitor structure, comprising:

a substrate having a first side and a second side opposite the first side, wherein the first and second sides of the substrate are spaced apart in a vertical direction;

first and second conductive microstrip transmission line segments on the first side of the substrate;

a conductive ground plane on the second side of the substrate;

first and second microstrip capacitor plates connected to respective ones of the first and second microstrip transmission line segments, wherein the first and second microstrip capacitor plates are separated by a dielectric gap;

a complementary resonator comprising a removed portion of the conductive ground plane that is aligned in the vertical direction with at least a portion of the dielectric gap;

wherein the first and second microstrip transmission line segments extend in a first direction of RF signal propagation;

wherein the complementary resonator comprises first and second complementary resonant structures spaced apart in a second direction that is perpendicular to the first direction, and a transverse portion that extends in the second direction and connects the first and second complementary resonant structures; and wherein the microstrip capacitor structure has a return loss of less than −25 dB over an RF bandwidth from 0.69 GHz to 1.0 GHz.

14. The microstrip capacitor structure of claim 13, wherein the microstrip capacitor structure has a capacitance of about 3 pF to about 4 pF; and wherein each of the complementary resonant structures comprises a spiral shape, a serpentine shape, or a polygonal shape.

15. The microstrip capacitor structure of claim 13, wherein the first and second microstrip capacitor plates comprise an interdigitated capacitor structure.

16. The microstrip capacitor structure of claim 13, wherein the complementary resonant structures are configured to resonate at a frequency of RF signals carried by the first and second microstrip transmission line segments.

17. A microstrip capacitor structure, comprising:

a substrate having a first side and a second side opposite the first side, wherein the first and second sides of the substrate are spaced apart in a vertical direction;

first and second conductive microstrip transmission line segments on the first side of the substrate;

a conductive ground plane on the second side of the substrate;

first and second microstrip capacitor plates connected to respective ones of the first and second microstrip transmission line segments, wherein the first and second microstrip capacitor plates are separated by a dielectric gap;

a complementary resonator comprising a removed portion of the conductive ground plane that is aligned in the vertical direction with at least a portion of the dielectric gap;

wherein the first and second microstrip transmission line segments extend in a first direction of RF signal propagation;

wherein the complementary resonator comprises first and second complementary resonant structures spaced apart in a second direction that is perpendicular to the first direction, and a transverse portion that extends in the second direction and connects the first and second complementary resonant structures; and wherein the first and second microstrip capacitor plates are arranged so that a majority of electric field lines extending between the first and second microstrip capacitor plates are oriented in the first direction.

18. The microstrip capacitor structure of claim 17, wherein the first and second microstrip capacitor plates are arranged so that a majority of electric field lines extending between the first and second microstrip capacitor plates are oriented in the second direction.

19. The microstrip capacitor structure of claim 17, wherein at least portions of the first and second microstrip capacitor plates are not aligned in the vertical direction with the removed portion of the ground plane.

20. The microstrip capacitor structure of claim 17, wherein the microstrip capacitor structure has a capacitance of about 3 pF to about 4 pF; and wherein each of the complementary resonant structures comprises a spiral shape, a serpentine shape, or a polygonal shape.

* * * * *